United States Patent [19]

Warner et al.

[11] Patent Number: 5,058,745

[45] Date of Patent: Oct. 22, 1991

[54] PRODUCT ADAPTABLE, PROCESS COMPATIBLE, ERGONOMIC MEANS AND METHOD FOR SAFE HANDLING, TRANSPORTING AND UNPACKING OF ARTICLES OF MANUFACTURE

[75] Inventors: Gary J. Warner, Weimar; Douglas S. Smith, Sacramento, both of Calif.

[73] Assignee: Hewlett-Packard Company, Palo Alto, Calif.

[21] Appl. No.: 517,279

[22] Filed: May 1, 1990

[51] Int. Cl.[5] ..... B65D 81/02; B65D 85/30

[52] U.S. Cl. ..... 206/523; 53/472; 206/320; 206/588

[58] Field of Search ..... 206/523, 320, 326, 588, 206/594; 53/472

[56] References Cited

U.S. PATENT DOCUMENTS

| | | | |
|---|---|---|---|
| 4,032,009 | 6/1977 | Taylor | 206/523 X |
| 4,522,303 | 6/1985 | Starr | 206/523 X |
| 4,584,822 | 4/1986 | Fielding et al. | 53/472 X |
| 4,759,446 | 7/1988 | Dobashi et al. | 206/594 X |
| 4,953,705 | 9/1990 | Evamy | 206/523 X |

FOREIGN PATENT DOCUMENTS

| | | | |
|---|---|---|---|
| 135793 | 11/1978 | Japan | 206/523 |
| 1001697 | 8/1965 | United Kingdom | 206/523 |

*Primary Examiner*—William I. Price

[57] ABSTRACT

A package assembly and method of loading and unloading said package assembly is disclosed. The package assembly of the present invention includes moving parts to make the loading and unloading steps of a relatively delicate instrument of substantial weight easier and safe. The basic package assembly includes four component parts: an outer carton 10, an inner carton 12, a blocking panel 14, and top tray 16. In several of the embodiments, the top tray 16 is combined as a single unit with either the blocking panel 14 or the inner carton 12, thus reducing the parts count to three. In the unloading of the instrument, blocking panel 14 and tray 16 are first removed, outer carton 10 is rotated about one of its lower edges 30 to bring side 31 to rest on the floor. During the rotation of outer carton 10, inner carton 12 slides within outer carton 10 to bring the bottom of the enclosed instrument to rest on its bottom surface within the outer carton 10 allowing its easy removal by sliding it from the packaging.

30 Claims, 10 Drawing Sheets

PRODUCT ADAPTABLE, PROCESS COMPATIBLE, ERGONOMIC MEANS AND METHOD FOR SAFE HANDLING, TRANSPORTING AND UNPACKING OF ARTICLES OF MANUFACTURE

BACKGROUND OF THE INVENTION

1. Field of Search

The present invention relates to packaging containers and methods of packing, unpacking, and repacking delicate items of substantial weight such as furniture, electronic instruments and computers.

2. Prior Art

Furniture, electronic instruments and computers, as well as other bulky items of substantial weight and of a somewhat delicate nature are usually packed in a corrugated paper or cardboard carton with preformed styrofoam support posts in each corner thereof to securely suspend the item being shipped inside the carton in a spaced apart relationship with each of the six sides of the carton. With this packaging configuration the item being shipped and the styrofoam support posts must be assembled one with respect to the other all at the same time before the item is loaded into the carton for shipping. This requires at least two people, and perhaps an overhead crane, to load the item into the carton, or the building of the carton around the item and its support posts.

Similarly, when the item is received at its destination at least two people will be required to remove the item from the carton. This is accomplished by either pulling the item straight up out of the carton together with its support posts, or by one person cutting away the carton while a second person holds the support posts around the item until they both can remove the item from the support posts.

Both the loading and unloading of an odd shaped item which may also not have its weight evenly distributed can present a particularly difficult situation.

It would be advantageous to have a package assembly that can easily be loaded and unloaded by one person without fear of damaging the item. The various embodiments and species of the present invention provide such a package assembly and method for loading and unloading same safely.

SUMMARY OF THE INVENTION

In accordance with the embodiments of the present invention there is shown a package assembly and method of loading and unloading same by one person. The basic package assembly of the present invention includes four component parts: an outer carton, an inner carton, a blocking panel, and top tray. In several of the embodiments of the present invention, the top tray is combined as a single unit with either the blocking panel or the inner carton, thus reducing the parts count to three.

DESCRIPTION OF THE PREFERRED EMBODIMENTS

The various embodiments of the package assembly of the present invention and the species of the elements of that assembly each cooperates to provide an assembly and method for loading and unloading same by one person. The package assembly of the present invention includes four component parts as will be seen in the following discussions of the various figures. These include an outer carton 10, an inner carton 12, a blocking panel 14, and a top tray 16 which are illustrated here in various forms or combinations. The forms and combinations that are illustrated here are by no means intended to illustrate all of the possible forms and configurations that the present invention may take.

Figure 1:
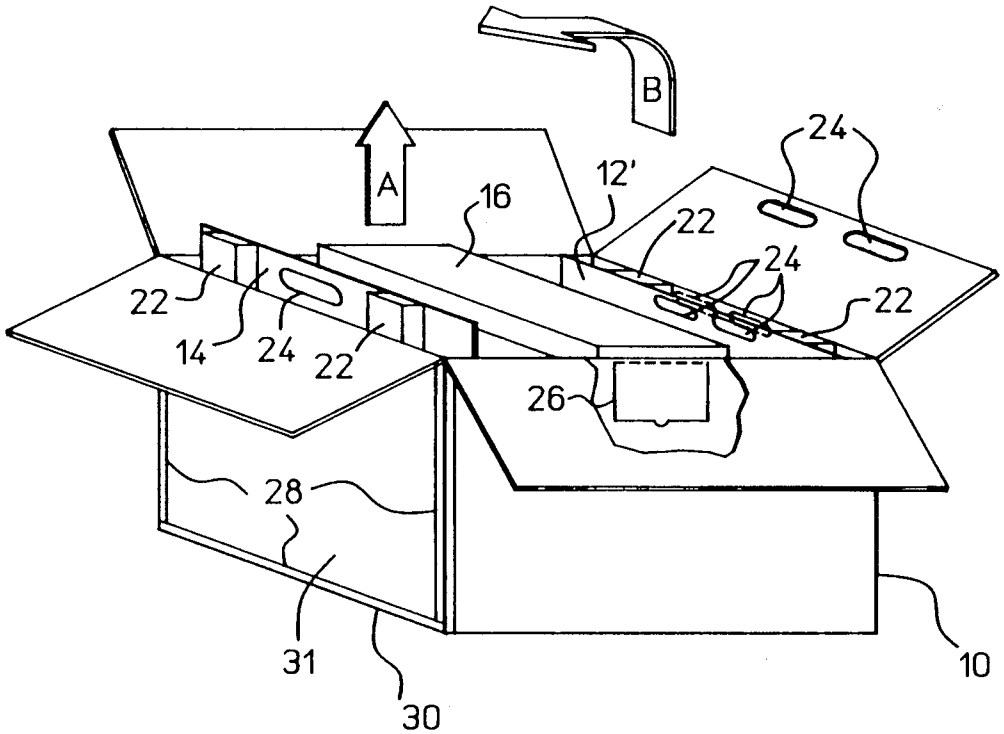
FIG. 1 is a perspective view of one embodiment of the present invention with the outer carton resting on its bottom surface with the top open.

Referring to FIG. 1 outer carton 10 is shown resting on the bottom thereof with its top flaps open in preparation for removal of its contents. In addition to outer carton 10, this view shows an accessory tray 16 in the top central portion of the interior of carton 10 to fill the space between the enclosed product and the top flaps of container 10, a portion of one of the sides of inner container 12, and blocking panel 14.

Figure 2:
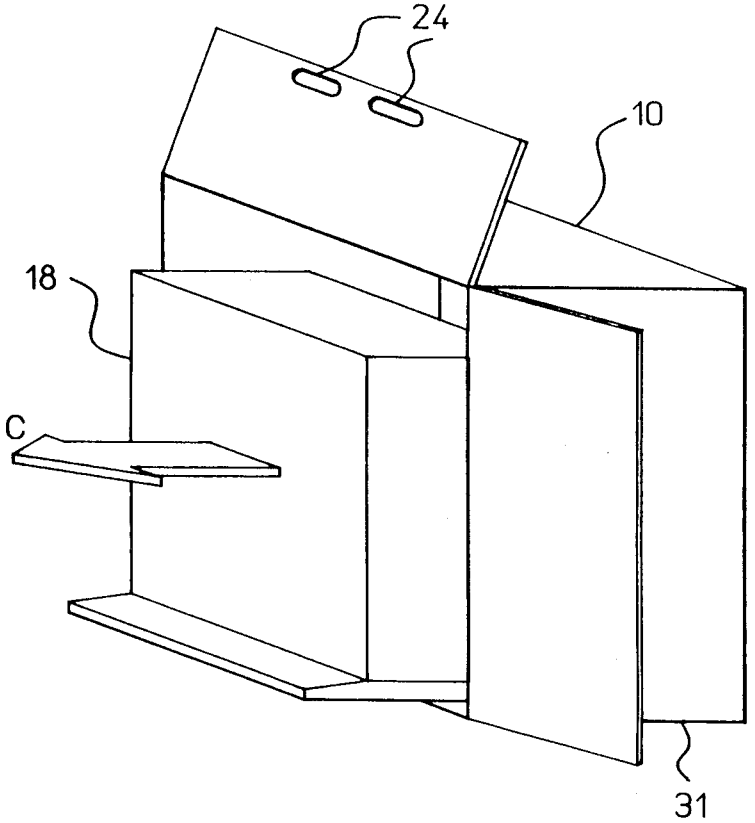
FIG. 2 is a simplified perspective view of the present invention with the outer carton on its side with the top open and the contents of the outer carton partially withdrawn therefrom.
Figure 13B:
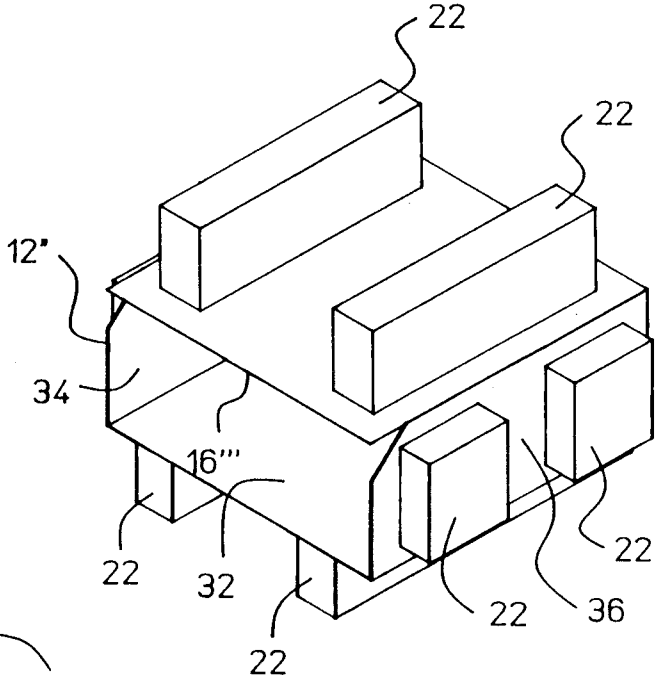
FIGS. 13*a* and 13*b* are perspective views of a combination of the inner carton and tray of the present invention.
Figure 13A:
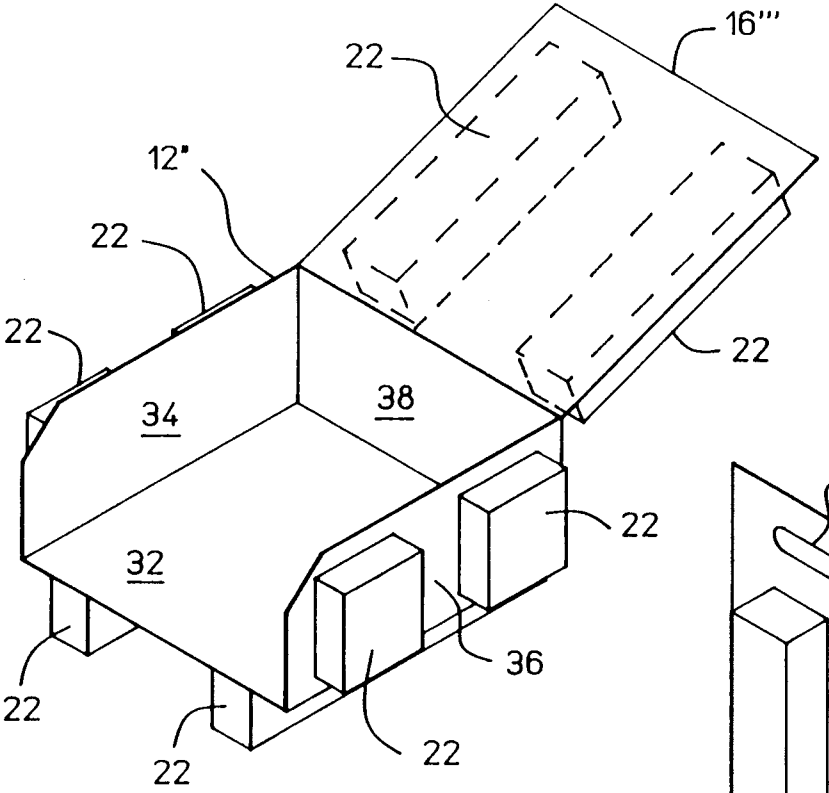

To unload the contents of carton 10, accessory tray 16 is first removed if it is a separate unit or folded outward if it is attached to one side of inner carton 12 similar to that shown in FIGS. 13*a*–13*b*. Then blocking panel 14 is removed by grasping it by hand hole 24 and pulling panel 14 straight upward and clear of carton 10 as indicated by arrow A. Next, the purchaser standing beside the side of carton 10 from which panel 14 had been extracted grasps hand holes 24 in the top edge of inner container 12' and pulls them toward himself in the direction of arrow B, thus rotating carton 10 about its lower edge 30 until carton 10 rests on side 31 as shown in FIG. 2. Since product 18 is lying on either its back or one of its sides in carton 10 during shipment, as carton 10 is rotated to stand on its side 31, product 18 and inner carton 12' slides along the inner surface of the bottom of carton 10 until the bottom of product 18 comes into contact with the inner surface of side 31. The removal of blocking panel 14 allows this repositioning of product 18 and inner carton 12' during the rotation of carton 10. Finally, product 18 is slid from carton 10 in the direction of arrow C.

Alternately, hand holes 24 for rotating carton 10 in the direction of arrow B could be in the side of carton 10 adjacent the top edge of inner carton 12', or near the farthest edge of the flap adjacent to the top edge of inner carton 12'. By placement of hand holes 24 in the free end of the flap of carton 10 the maximum leverage is afforded the purchaser in the rotation of carton 10 about edge 30 and minimizes the reach across carton 10 when the carton is of substantial size. This may also prove advantageous when product 18 is of substantial weight.

Accessory tray 16 is provided to house operating manuals, keyboard, software, etc. for use with the instrument being shipped in carton 10. Accessory tray 16 can either be loaded prior to closure of the top flaps of carton 10 at the time of packaging of the instrument, or as is often the case, the accessories are not added until the specific customer to whom the instrument is to be shipped is identified and a packaged unit removed from the warehouse. To minimize the number of different units being warehoused, the accessories can be inserted into the sealed carton 10 by inclusion of an accessory door 26 through the side of carton 10 adjacent the end of accessory tray 16. To insert the accessories that match the language and power requirements of the customer, door 26 is opened, the accessories slipped into tray 16 through door 26, and then door 26 sealed with tape to maintain closure during shipment.

A further option illustrated in FIG. 1 is the use of rip cord tape 28 along the vertical sides and edge 30 of side 31. If this is included the purchaser can remove tape 28 from at least the vertical edges before the rotation of carton 10, and then after that rotation push carton 10 back so that its bottom again rests on the floor. If tape 28 is removed from all three edges, carton 10, minus side 31, can be removed from the unpackaging site completely with product 18 being in the open and sitting on side 31 o the floor if side 31 was removed before the rotation step. Alternately, the edges of side 31 could be perforated instead of using tape 28. After carton 10 is rotted to the position of FIG. 2, the purchaser can grasp carton 10 and tug it in the opposite direction to that of arrow B to tear side 31 free, if the edges of side 31 are perforated, with the weight of product 18 holding side 31 in place as the rest of carton 10 is torn away.

Figure 3:
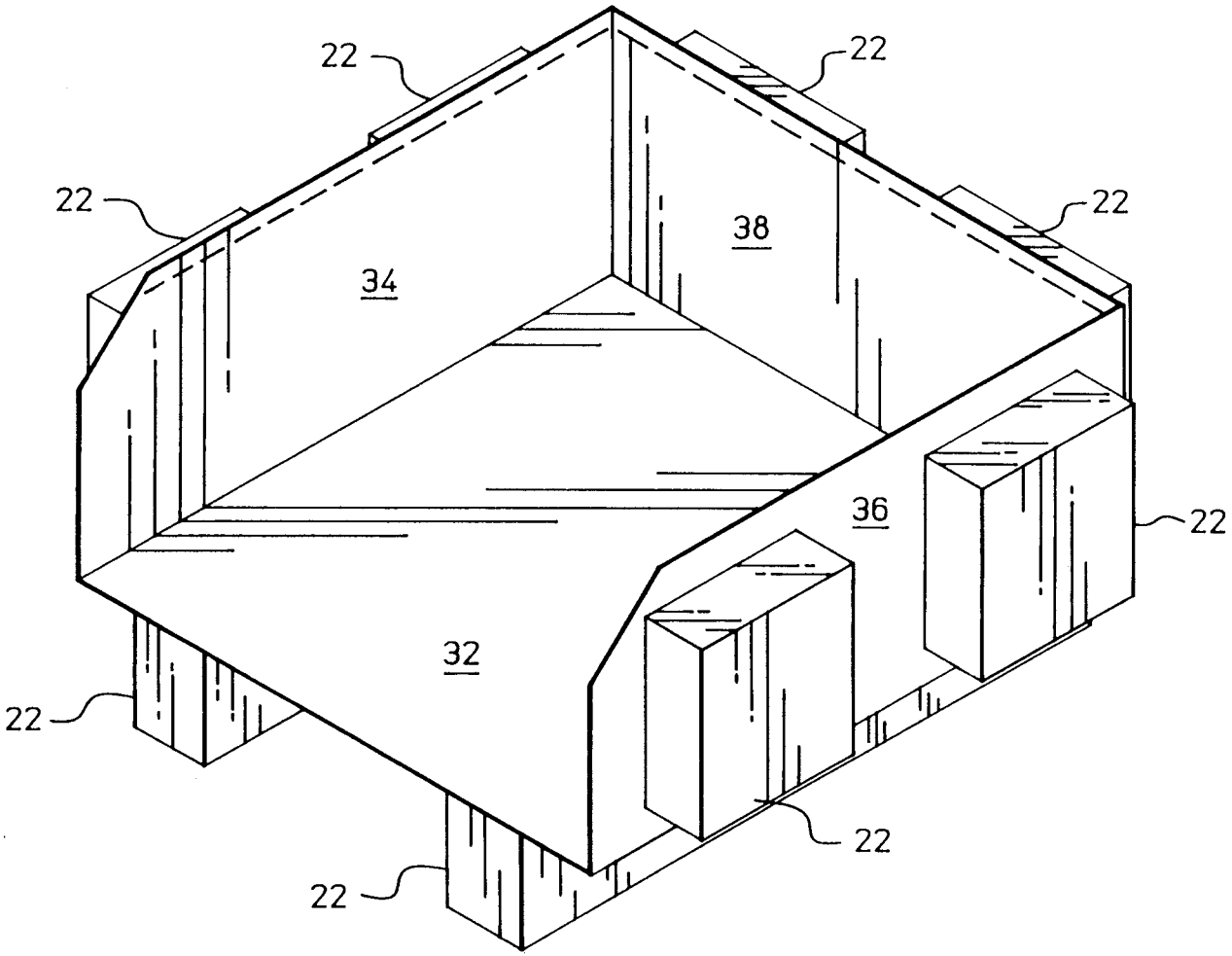
FIG. 3 is a perspective view of one species of the inner carton of the present invention.

Referring next to FIG. 3 there is shown a perspective view of one variation of inner carton 12. Inner carton 12 includes bottom 32, first side 34, second side 36, and third side 38. Glued near opposite edges of first, second and third sides 34–38, and beneath bottom 32 are support blocks 22. Each of blocks 22 that are attached to sides 34–38 is substantially square and blocks 22 attached beneath bottom 32 are rectangular and run substantially the full length of bottom 32. Blocks 22 on sides 34–38 are provided to prevent product 18 from moving laterally, and blocks 22 beneath bottom 32 support the weight of product 18 during shipment. The back or one of the sides of product 18 rests on bottom 32, thus the spacing between first and second sides 34 and 36 is substantially the same as the dimension of the surface of product 18 that is to rest there. Similarly, the length of bottom 32 from the free edge to third side 38 is not necessarily any greater but can be greater than the height of product 18. Some products 18 are designed such that the lower portion of them must extend beyond the free edge of bottom 32 (e.g. desk side computer shown in FIG. 2 with a bottom foot print that is wider and deeper than the dimensions of the upper portion of the computer). Where this is the case, the top of product 18 is placed in contact with third side 38 and the bottom of product 18 extends some what beyond the free edge of bottom 32 and first and second sides 34 and 36. In all applications the bottom of product 18 will always be oriented toward the free edge of bottom 32, typically perpendicular to first and second sides 34 and 36 and the free edge of bottom 32 (i.e., could be at 75° or 60° or whatever is suitable for peculiar products.

The size of blocks 22 is determined by several factors, as is the material from which they are made. The sizing of blocks 22 is determined by container standards which may require spacing of the surface of the enclosed product away from the inner surface of the outer carton to minimize damage to the product that might result from minor denting or puncturing of the outer carton, and to support the weight of the enclosed product and cushion impact to the product should the package assembly be dropped. The material of the blocks is also determined by some of these same factors. For a delicate instrument such as a computer weighing approximately seventy pounds with a hard disk drive, blocks of high density polyethylene foam of approximately four inches thick were found to meet all of the packaging requirements.

Figure 4:
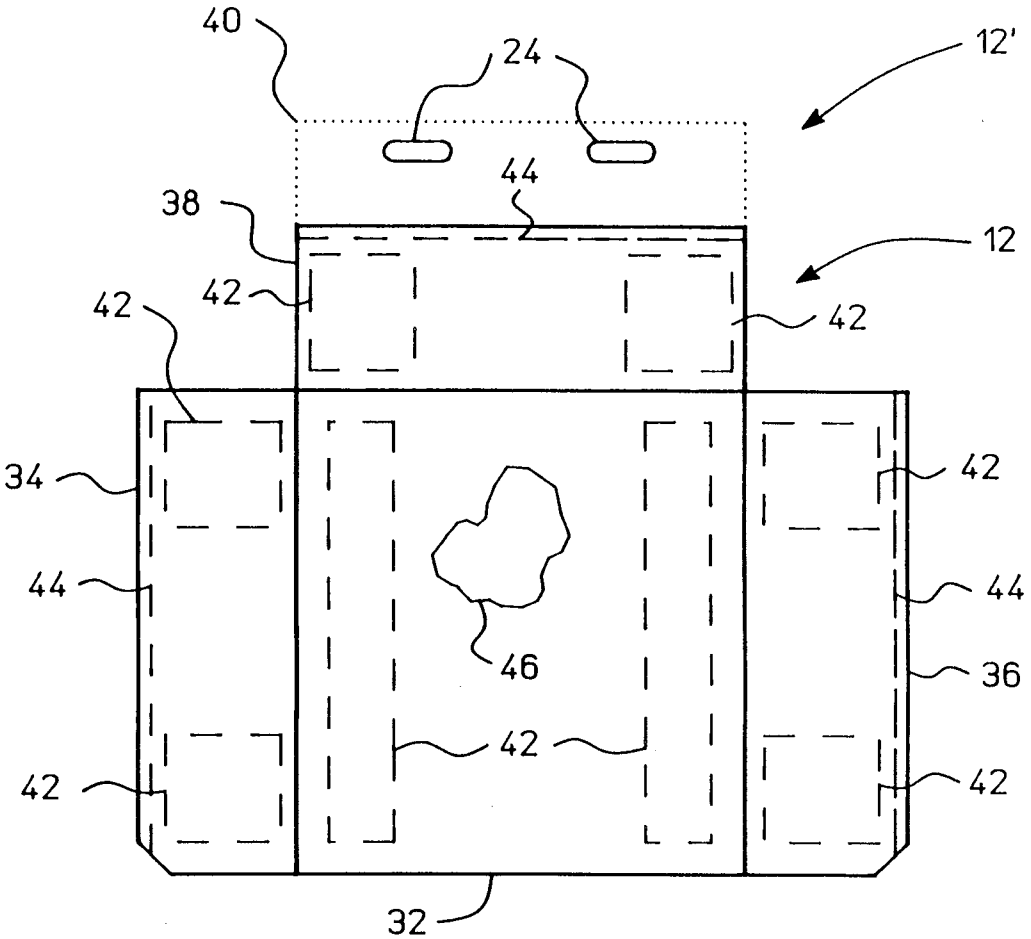
FIG. 4 is a plan view of an unfolded inner carton that shows two of the species of the inner carton of the present invention one of which is shown in FIG. 3.

FIG. 4 is a plan view of inner carton 12 and 12' to illustrate that it is made of a single piece of corrugated paper, or similar material, that is folded into shape. The only difference between inner cartons 12 and 12' is that inner carton 12' has an extended (40) third side 38 so that third side 38 extends upward to the top edge of carton 10 within the flaps as shown in FIG. 1. Also shown in FIG. 4 in dotted outline 42 are the locations for supporting blocks 22, and an optional cut-out in bottom 32 to accommodate a projection from the surface of product 18 that is to rest on bottom 32 to permit the support of product 18 on its otherwise flat side or back surface during shipping. Additionally for a product that has a surface that is substantially flat except for a projection in one area, and that surface is to rest on bottom 32 during shipment, a cut-out 46 to accommodate that projection is provided in bottom 32. Thus, when product 18 is loaded, bottom 32 supports all of that surface while allowing the projection to extend through bottom 32 into the region between inner carton 12 and outer carton 10. To ease the loading product 18 into the combination of cartons 10 and 12, FIGS. 3 and 4 show two additional features that will be discussed more fully below with respect to FIG. 11. These features are the clipped or rounded corners of first and second sides 34 and 36 along their top and free edges, and scoring 44 within approximately one inch of the top edges of first, second and third sides 34–38.

Figure 14:
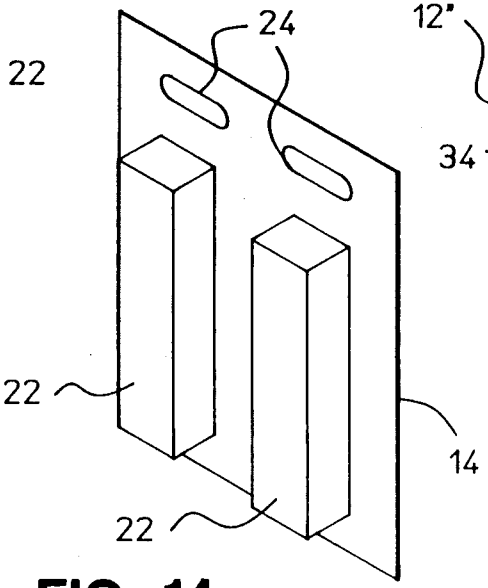
FIG. 14 is a perspective view of the blocking panel of FIG. 1.

While FIGS. 3 and 4 illustrate one form for inner container 12 of the present invention, FIG. 14 illustrates one form of blocking panel 14 which is inserted into outer carton 10 adjacent the free end of inner carton 12 and juxtaposed the bottom of product 18 (see FIGS. 1, 8, 9 and 11). In the simplest form, blocking panel 14 is no larger than the size or as the bottom of product size and shape as the side of outer container 10 adjacent to which it is located, and no smaller than the size and shape of the bottom of product 18. Along its upper edge, panel 14 includes at least one hand hole 24, or the like. On the side of panel 14 to be positioned away from the bottom of product 18 there are attached two support blocks 22 that are sufficiently in from the vertical edges of panel 14 to be adjacent to the bottom of product 18 so as to oppose any lateral motion in the direction of blocking panel 14. Alternately, blocking panel 14 can be a large foam mold or block.

Figure 6:
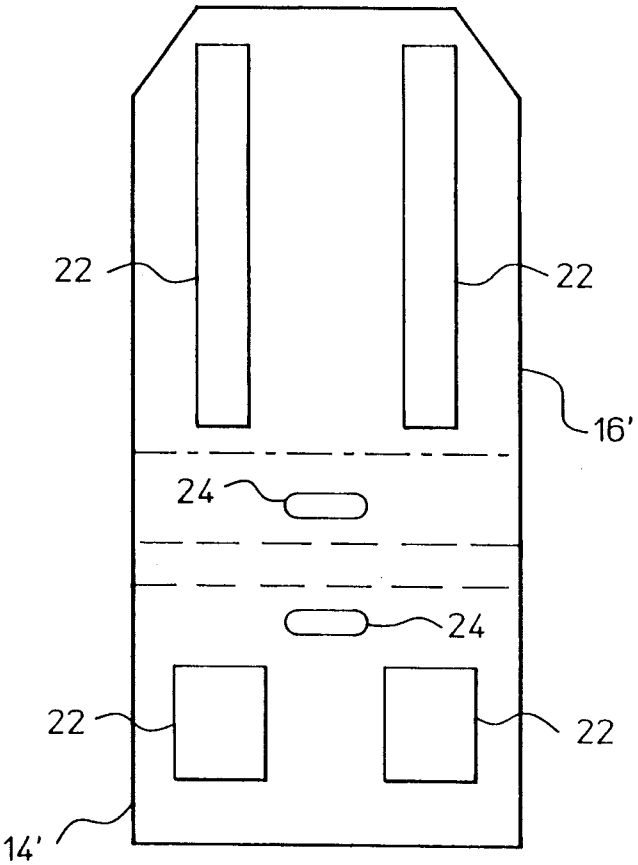
FIG. 6 is a plan view of an unfolded combination of blocking panel and tray of the present invention as shown in FIG. 5.
Figure 5:
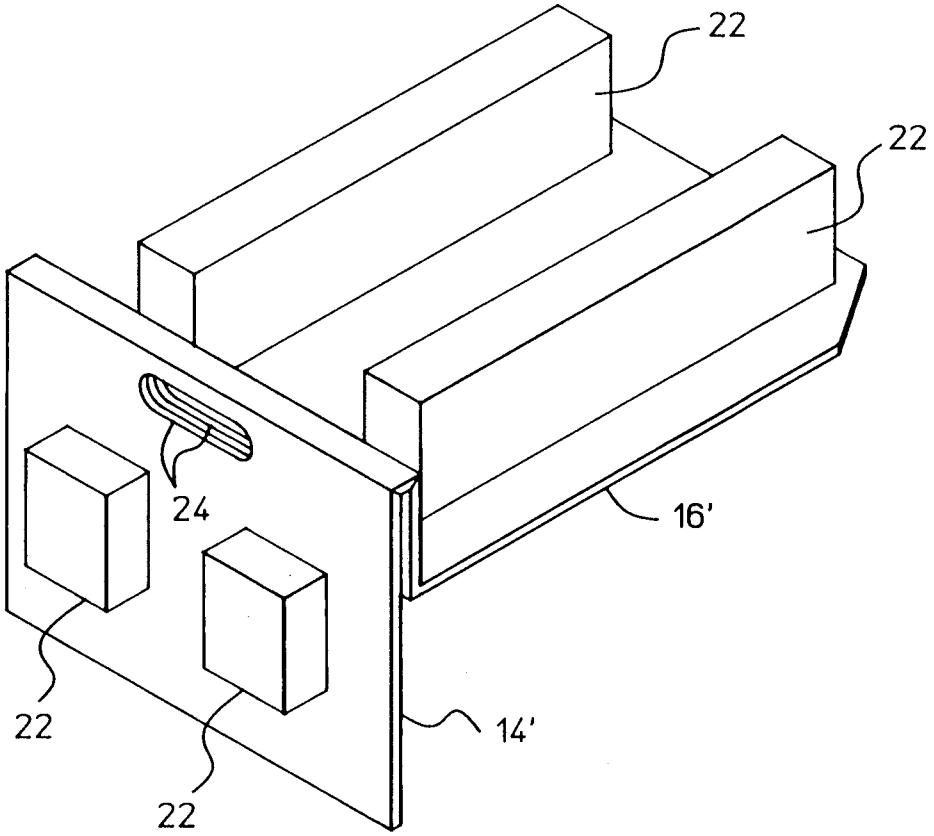
FIG. 5 is a perspective view of one species of a combination of the blocking panel and tray of the present invention.

FIGS. 5 and 6 show the combination of blocking panel 14' and tray 16' constructed from a single sheet of corrugated paper board. The blocking panel portion 14' is substantially the same as blocking panel 14 of FIG. 14. To form the combination, the flat corrugated paper board cutout is folded along three lines, folded downward along the broken lines and up along the broken and dotted line to form the horizontal tray portion 16'. When the unit has been folded as shown in FIG. 5, the under side of tray portion 16' will come into contact with the upper most surface of product 18 as it rests in inner carton 12. Additionally, blocks 22 are attached to tray 16' and extend upward a sufficient distance to fill the vertical space between tray 16' and the flaps of outer carton 10 when the flaps are closed. Any accessories manuals, software, etc. that is to be used with product 18 could be shipped between blocks 22 on top of tray 16' having been placed there through door 26 or on tray 16' before outer carton 10 is sealed.

Figure 7:
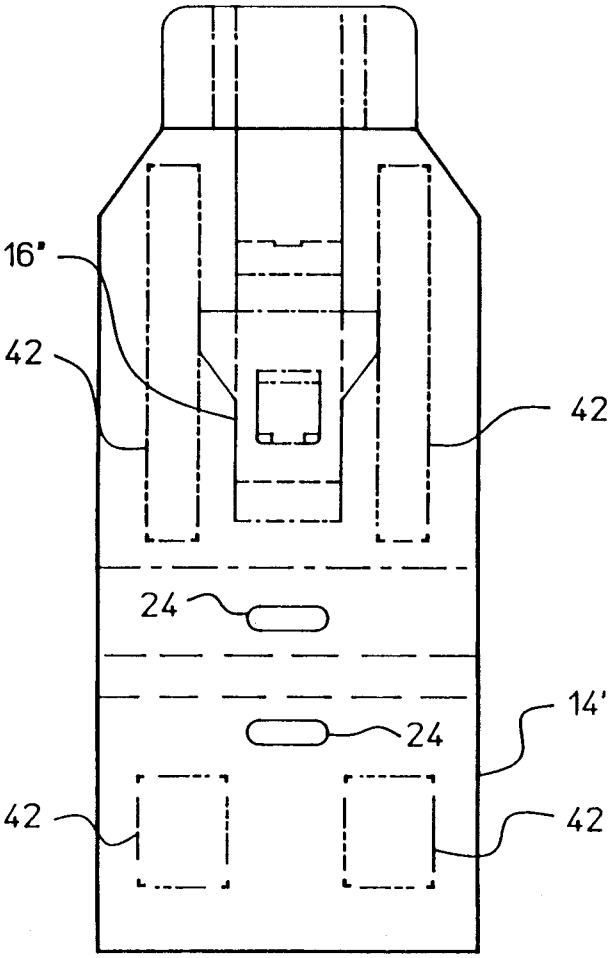
FIG. 7 is a plan view of an unfolded combination of blocking panel and tray of a second species of the present invention as shown in FIG. 5 which also includes accessory retaining means.

Moving on to FIG. 7 there is shown another form for the tray portion of the combined blocking panel and tray of FIGS. 5 and 6. Here tray 16'' is further cut-out to form accessory compartments between support blocks 22. Note that with the use of this blocking panel-tray combination, the accessory holding tray portion is turned through 90° in comparison to tray 16 of FIG. 1. That being the case, door 26 in outer carton 10 will have to be relocated in the side of carton 10 that will become the top of carton 10 when it is rotated to the position of FIG. 2.

Figure 8:
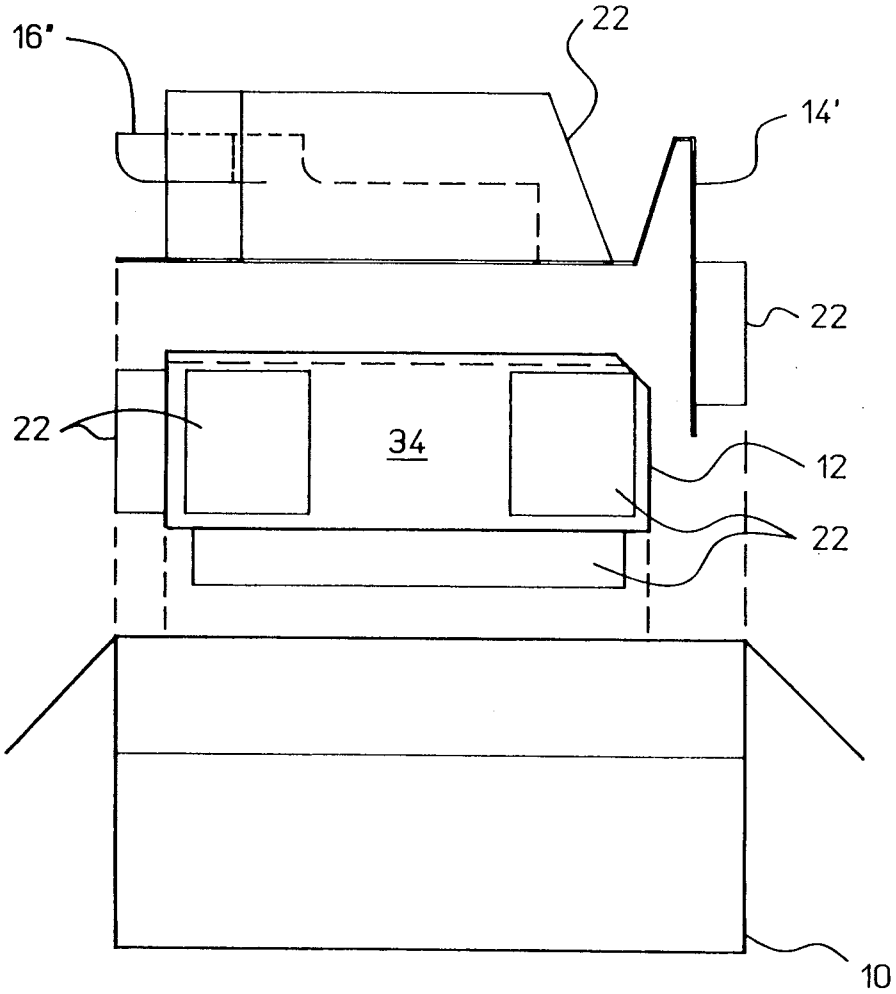
FIG. 8 is an exploded plan view of the outer carton of FIG. 1, inner carton of FIG. 3, and the combined blocking panel and tray of FIG. 5 modified as in FIG. 7 to illustrate their relationship one with respect to the other when assembled into the outer carton to form the present invention.

The exploded side plan view of FIG. 8 illustrates the relationship of outer carton 10, inner carton 12, and the combined blocking panel 14' and tray 16''. Inner carton 12 is inserted into outer carton 10 so that the free vertical surface of each of blocks 22 contact an inner surface of outer carton 10. The blocking panel 14' portion of the combined panel and tray extends downward between the free end of inner carton 12 and the inner surface of outer carton 10 and tray 16'' rests on the top of product 18 substantially above inner carton 12.

Figure 11:
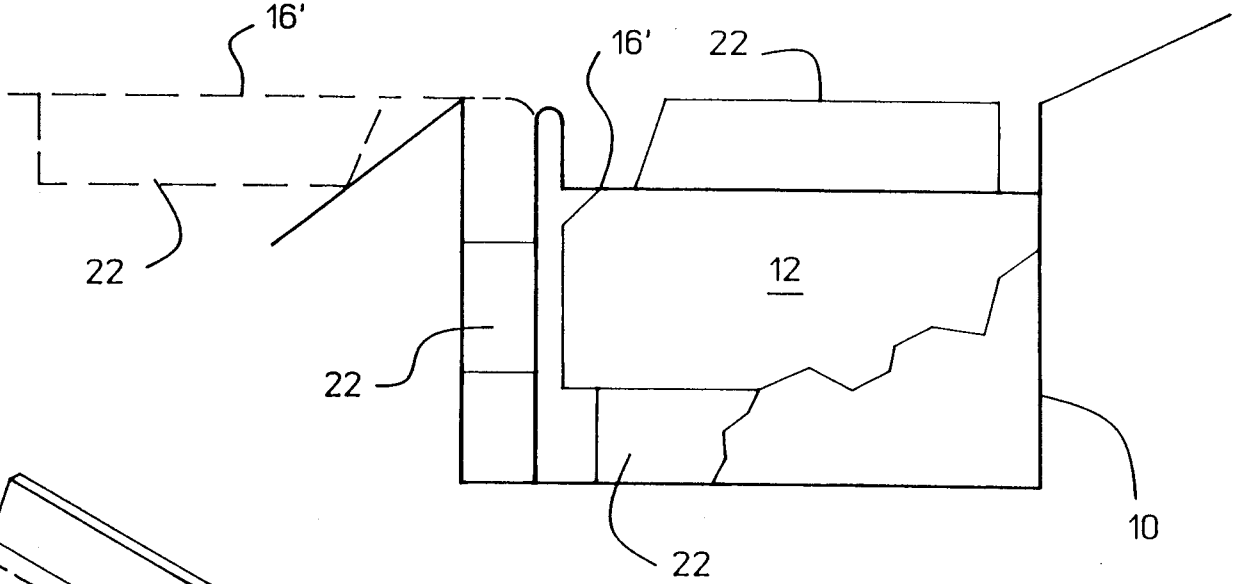
FIG. 11 is a partial cut-away side view of the outer carton to illustrate the location of the inner carton and blocking panel/tray combination therein, and the alternative position of the tray during the insertion of the product to be shipped therein.

FIG. 11 shows the components of FIG. 8 within outer carton 10 through a cut-away portion of the side of outer carton 10. This figure also shows, in outline, the alternative position of tray 16', namely folded back over the top edge of outer carton 10. This design of the combination of blocking panel and tray makes this possible to facilitate loading of product 18 into the package assembly for shipment. This configuration of the components thus provides a guide, the back side of blocking panel 14', along which the bottom of product 18 is directed so that the top of product 18 will be directed to come into contact with third side 38 of inner carton 12. Product 18 can be loaded into inner carton 12 without blocking panel 14 being in place, however, greater guidance must be provided to properly locate product 18 within inner carton 12 since it can not b easily moved once it is located within inner carton 12. Additionally, as mentioned above, the top edges of each of first, second and third sides 34–38 of inner carton 12 can be scored (44) to create a soft upper edge of each of those sides so that if product 18 gets hung-up on one of those edges as it is being loaded into inner carton 12, the edge will partially fold outward and allow product 18 to continue its downward progress into inner container 12. Also, for a product that has a larger base portion, such as a flange as does product 18 in FIG. 2, the upper free end corners of first and second sides 34 and 36 can be cut-off at an angle or rounded to guide the flange or foot of product 18 into the space between the free end of inner carton 12 and blocking panel 14 in any of its variations.

Figure 12:
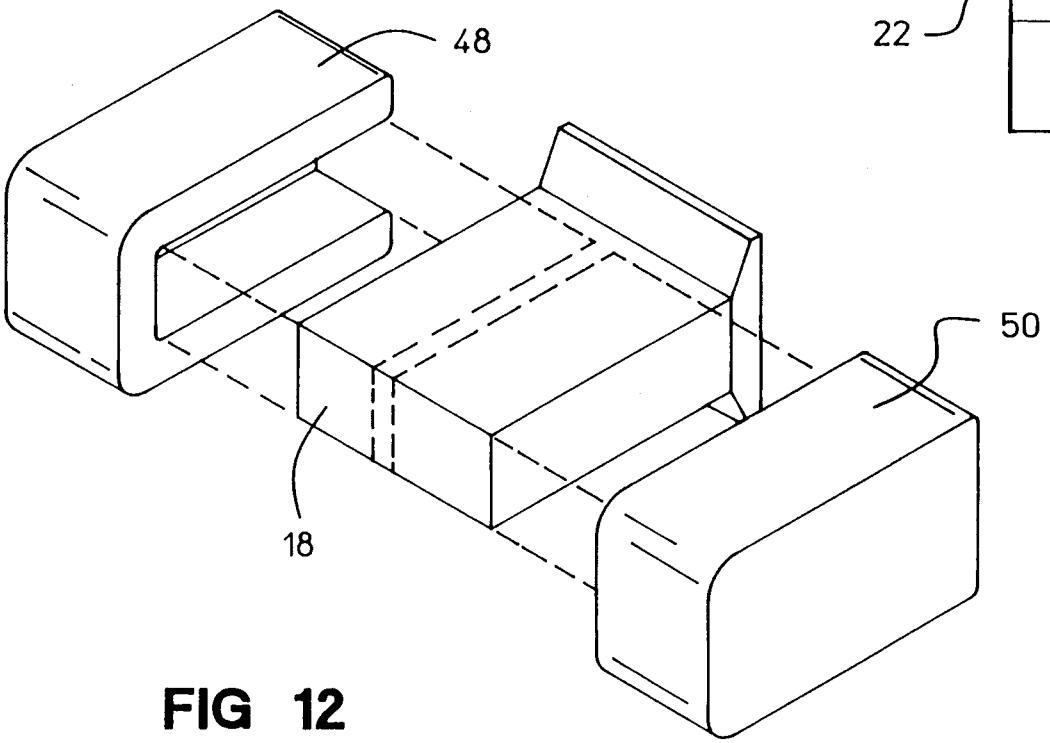
FIG. 12 is an exploded perspective view of a second species of the inner carton of the present invention.

An alternative to inner carton 12 is a pair of opposing foam caps, or clam shells, 48 and 50 as shown in FIG. 12. Each of the shells have a "U" shaped cavity in two directions formed therein to fit over the top portion of product 18 without extending below the bottom edge of product 18. When caps 48 and 50 are placed on product 18 they cover the portion of product 18 as shown by the dotted lines thereon in this figure.

FIGS. 13*a* and 13*b* show another variation on the location of tray 16, here it is shown attached to, and an integral part of, inner carton 12. In FIG. 13*a* tray 16''' is tilted upward away from the top of inner carton 12'', and in FIG. 13*b* tray 16''' is shown in the closed position. While in these views tray 16''' is shown attached to third side 38, it could alternatively be attached to the upper edge of either first or second sides 34 and 36.

Figure 9:
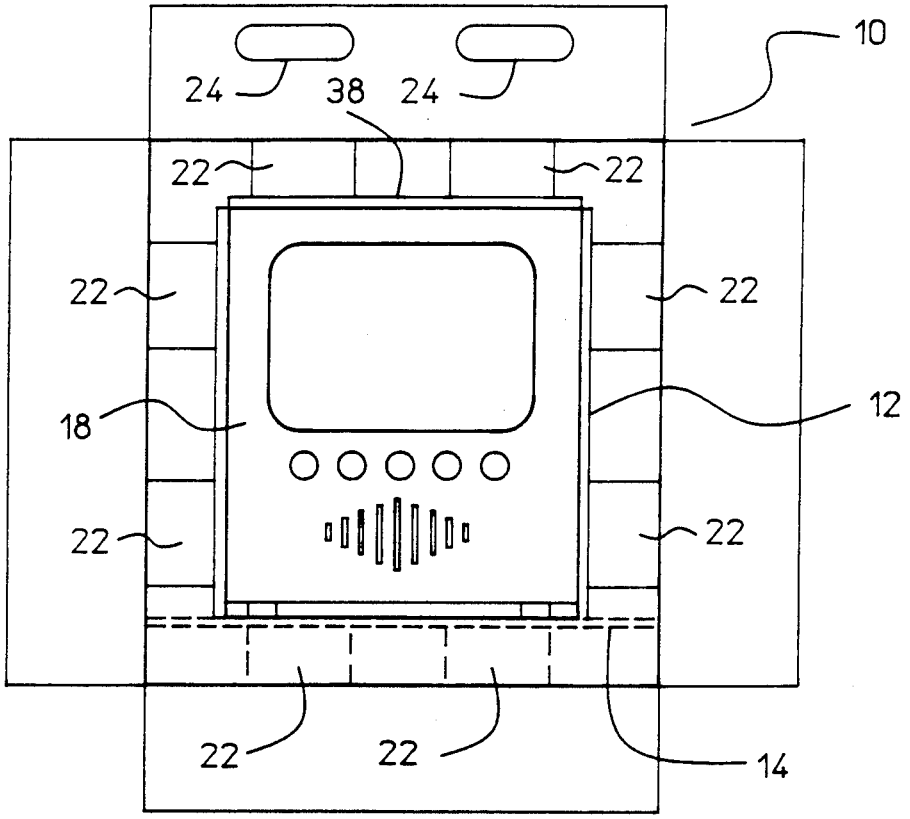
FIG. 9 is a plan top view of an outer carton with the top flaps open and the outer carton resting on the bottom thereof to illustrate the positioning of the inner carton and packaged product after the blocking panel is removed.
Figure 10:
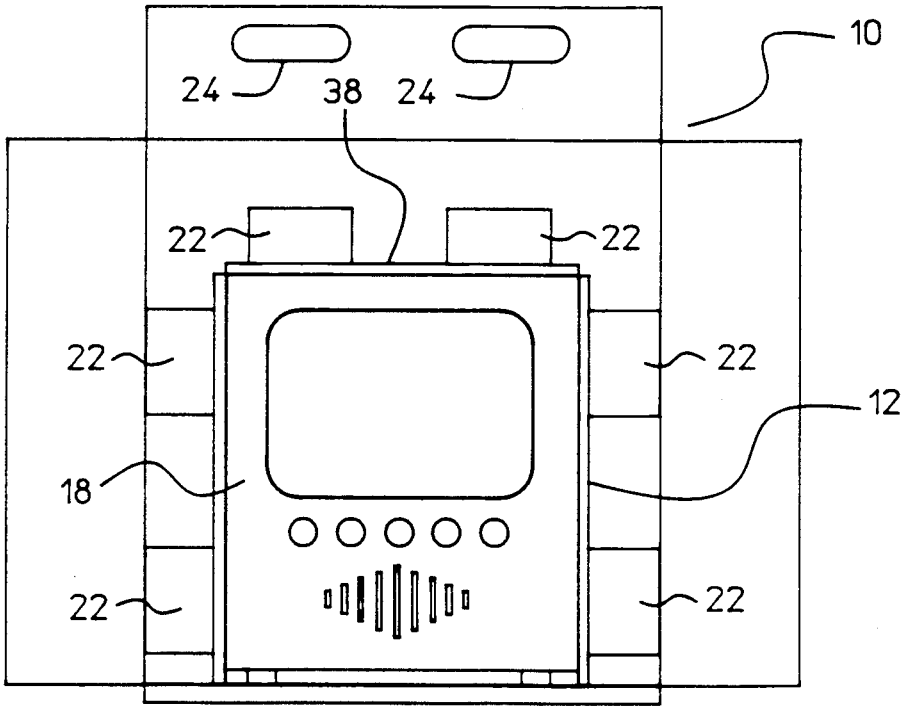
FIG. 10 is the same outer carton with product contained therein as in FIG. 9 with the outer carton resting of the side thereof that corresponds to the side where the blocking panel was originally located.

FIGS. 9 and 10 have been included to further illustrate the operation of the package assembly of the present invention in the unloading process. In FIG. 9 outer carton 10 is still resting on its bottom surface with the tray and blocking panel (shown in dotted-outline) having been removed, and product 18 resting in inner carton 12 (blocks on third side 38 against the inner surface of the side of outer carton 10). Then as carton 10 is rotated about edge 30, inner carton 12 with product 18 in it slides along the inside of the bottom of outer carton 10 until the bottom of product 18 comes into contact with the inner surface of the opposite side of outer container 10 which finally comes into contact with the floor. If the clam shell inner carton design is used, a similar effect occurs. So once product 18 is in the position shown in FIG. 10, it may be slid out of outer carton 10 with its base on the floor and moved into the desired location without lifting product 18 up and out of carton 10.

Outer carton 10 can be a regular slotted carton (RSC) for economy or any other container configuration which generally houses manufactured product and houses inner support means for said product. Outer carton !0 provides ergonomic means of loading and unloading manufactured product, with inner support means repositioned or removed. Specifically for loading or unloading product, the RSC provides four flaps which can be folded to provide an opening through which the product can be loaded or unloaded. Additionally, the RSC provides a handle or handles which can be readily grasped by a user for effecting a convenient reorientation of the product as by tilting, pushing, pulling, turning, leveraging, or otherwise augmenting the reorientation of the product by the purchaser.

Outer carton 10, with inner elements which operate together not only to protect the enclosed product during shipment, they also enable ready and convenient loading and unloading of the product into and out of the package assembly. In particular, an inner support includes one or more elements in such a way that it can be repositioned or removed either singly or multiply (e.g. tray, blocking panel, and inner carton). With the inner support repositioned or removed either singly or multiply, the outer container provides ergonomic means of admitting entry or removal of the product that is being loaded or unloaded.

The package assembly of the present invention includes both passive and active components during the loading and unloading processes, some of which are never active, some that are active only during one of the stages of loading and unloading, and others that are active during both loading and unloading. This also varies depending on which of the two possible loading techniques are used. In one loading technique product 18 is lowered by means of an over-head crane or similar device into outer carton 10 with inner carton 12 in place therewithin. Here outer carton 10 and inner carton 12 are both passive, blocking panel 14 is either passive or active depending on whether it is inserted before or after product 18 is inserted, and tray 16 is active. The other loading technique is the reverse of the unloading technique discussed above. Here, as in the unloading technique, all components are active.

An alternative embodiment to the inner carton 12 would be to glue the support blocks 22 that above were glued to inner carton 12, to the bottom and the three sides of outer carton 10 that they were shown adjacent to in FIG. 9. In this configuration product 18 would slide along blocks 22 as outer carton 10 is rotated to its side as discussed above.

Figure 15A:
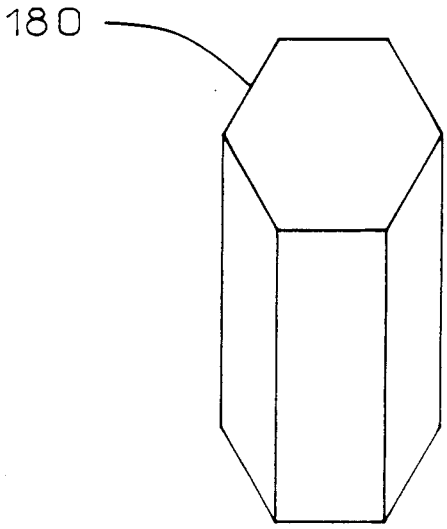
FIG. 15*a* is a perspective view of a product that has a hexagonal shaped top and bottom surfaces.
Figure 15B:
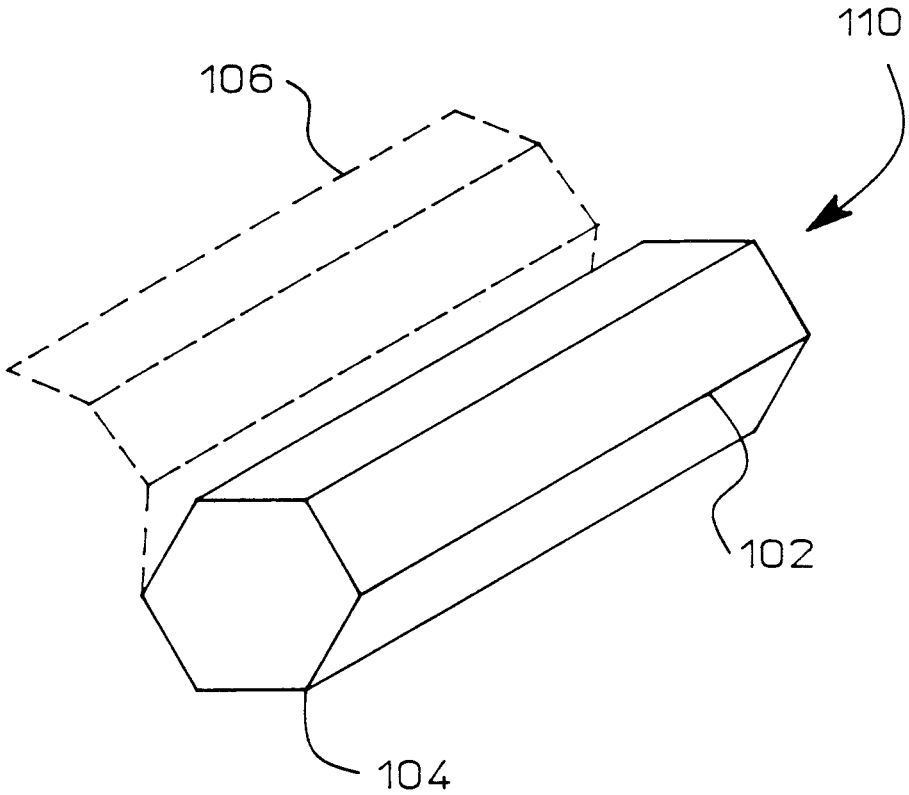
FIG. 15*b* is a perspective view of the carton for the product of FIG. 15*a*.

FIG. 15*a* shows a product 180 that has a hexagonal top and bottom surface and FIG. 15*b* shows an outer carton 110 for shipping product 180 lying on its side. Also shown in FIG. 15*b* in phantom outline is top 106 of outer carton 110, in the open position. Top 106 opens along edge 102. In the unpacking process the blocking panel adjacent the bottom of product 180 is removed and outer carton 110 is rotated around edge 104.

Figure 16:
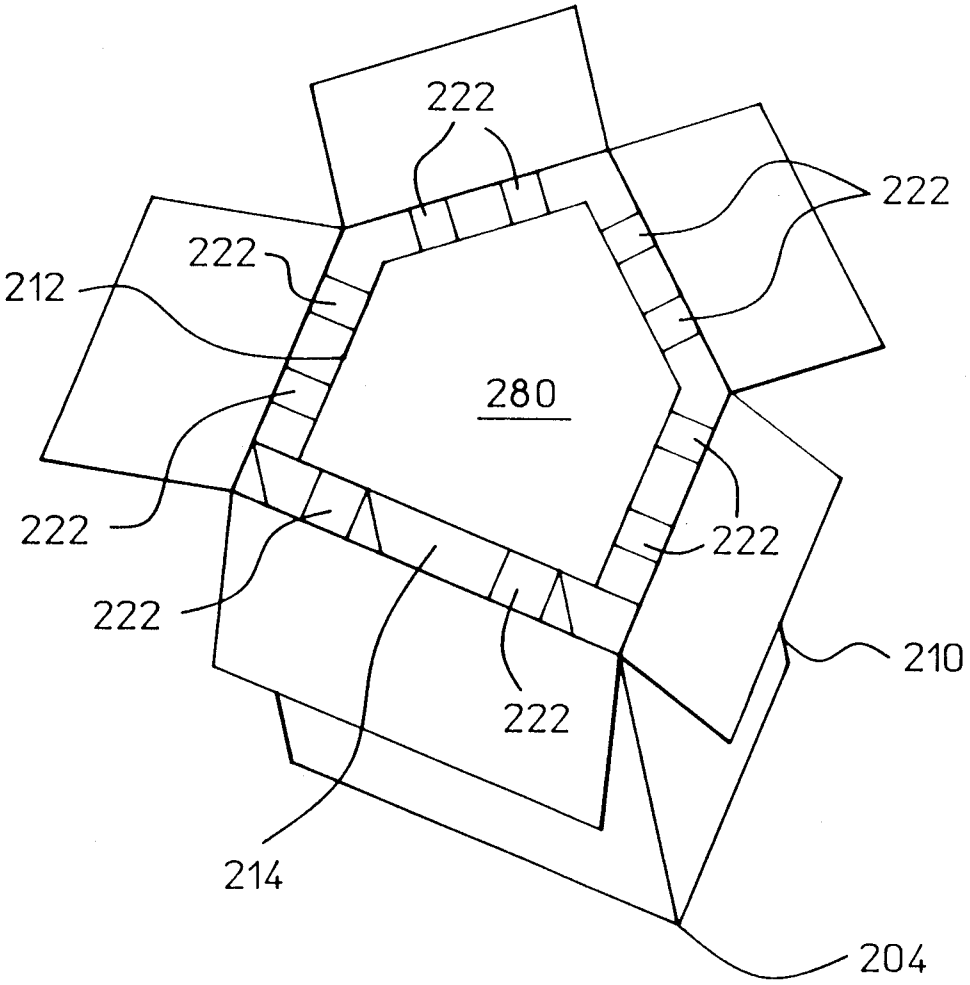
FIG. 16 is a perspective view of another specially shaped carton of the present invention.

FIG. 16 shows another shaped carton 210 of the present invention for shipping pentagonally shaped product 280. Product 280 is cradled in inner container 212 with its associated support blocks 222. Between the bottom of product 280 and the side of outer carton 210 that is not adjacent inner carton 212 is blocking panel 214. In the unloading process blocking panel 214 is removed and outer carton 210 is rotated about edge 204.

Although several preferred embodiments and species of components of the package assembly of the present invention have been described, the scope of this invention is by no means limited to only such embodiments and species. One skilled in the art can easily modify this invention for various other applications without departing from the spirit and scope of this invention. Therefore, the true scope of the present invention is only limited by the scope of the appended claims.

What is claimed is:

1. A package assembly for protecting a product during shipping which enables ready, convenient, ergonomically safe, and product protective entry thereinto and removal therefrom, said package assembly comprising:

an outer carton having a first plurality of sides connected sequentially to each other along their vertical edges, a polygonally shaped bottom portion connected to a first set of horizontal contiguous edges of each of said plurality of sides, and a second plurality of flaps selectively in communication with a second set of horizontal contiguous edges of each of said first plurality of sides which when folded toward each other form a polygonally shaped top of said outer carton; and inner package means having:

inner carton means locatable within said outer carton in contact with the inner surface of at least two of said first plurality of sides and the bottom of said outer carton for cradling said product for shipment; and blocking means locatable between the sides of said first plurality of sides of said outer carton that are not in contact with said inner carton and at least the bottom of said product within said inner carton means for passively holding said product during shipment and when said blocking means is removed from said outer carton for permitting the active relocation of said product in said outer carton to a position wherein the bottom of said product comes into contact with the inner surface of one of the sides adjacent to the former position of said blocking means as said outer carton is rotated about the bottom edge of that side to bring that side to rest on the surface supporting said outer carton.

2. A package assembly for protecting a product during shipping which enables ready, convenient, ergonomically safe, and product protective entry thereinto and removal therefrom, said package assembly comprising:

an outer carton having a first plurality of sides connected sequentially to each other along their vertical edges, a polygonally shaped bottom portion connected to a first set of horizontal contiguous edges of each of said plurality of sides, and a second plurality of flaps selectively in communication with a second set of horizontal contiguous edges of each of said first plurality of sides which when folded toward each other form a polygonally shaped top of said outer carton; and support and cushioning means locatable within said outer carton adjacent to the inner surface of at least two of said first plurality of sides and the bottom of said outer carton for supporting said product for shipment; and blocking means locatable between the sides of said first plurality of sides of said outer carton that are not adjacent said support and cushioning means and at least the bottom of said product for passively holding said product during shipment and when said blocking means is removed from said outer carton for permitting the active relocation of said product to a position wherein the bottom of said product comes into contact with the inner surface one of the sides adjacent to the former position of said blocking means as said outer carton is rotated about the bottom edge of that side to bring that side to rest on the surface supporting said outer carton.

3. A convenient, ergonomically safe method for packaging and unpackaging a product using a package assembly including an outer carton having a first plurality of sides connected sequentially to each other along their vertical edges, a polygonally shaped bottom portion connected to a first set of horizontal contiguous edges of each of said first plurality of sides, and a second plurality of flaps selectively in communication with a second set of horizontal contiguous edges of each of said first plurality of sides which when folded toward each other form a polygonally shaped top of said outer carton, inner carton and blocking panel, said method comprising the steps of:

a. locating said inner carton within said outer carton in contact with the inner surface of at least two of said first plurality of sides and the bottom thereof;

b. loading said product within said inner carton with the bottom thereof facing a side of said inner carton that is not in contact with one of the sides of said outer carton to be cradled therewithin during shipment following step a.;

c. inserting said blocking panel within said outer carton between the sides of said first plurality of sides of said outer carton that are not in contact with said inner carton and at least the bottom of said product for passively holding said product during shipment; and d. closing the flaps of said outer carton in preparation for shipment following steps a. through c.

4. A method as in claim 3 further including the steps of:

e. opening the flaps of said outer carton where unloading of the product is desired;

f. removing said blocking panel from said outer carton following step e.;

g. rotating said outer carton about the bottom edge of one of the sides adjacent to the former position of said blocking means as said outer carton is rotated about the bottom edge of that side to bring that side to rest on the surface supporting said outer carton to cause the active relocation of said inner carton by sliding along the inner surface of the bottom of said outer carton to bring the bottom of said product into contact with the inner surface that side following step f.; and h. sliding said product along the inner surface of the side in contact with the support surface to remove said product from said package assembly following step g.

5. A convenient, ergonomically safe method for packaging and unpackaging a product using a package assembly including an outer carton having a first plurality of sides connected sequentially to each other along their vertical edges, a polygonally shaped bottom portion connected to a first set of horizontal contiguous edges of each of said first plurality of sides, and a second plurality of flaps selectively in communication with a second set of horizontal contiguous edges of each of said first plurality of sides which when folded toward each other form a polygonally shaped top of said outer carton, inner carton and blocking panel, said method comprising the steps of:

a. placing said inner carton over said product with said product oriented to fit within said outer carton;

b. sliding the bottom of said product and inner carton along the inner surface of one of said first plurality of sides of said outer carton until the inner carton comes into contact with the inner surface of the bottom of said outer carton following step a.;

c. rotating said outer carton about the bottom edge of said one of said sides thereof until said bottom portion of said outer carton comes into contact with the surface supporting said outer carton following step b.;

d. sliding the combination of said product and said inner carton along the inner surface of the bottom of said outer carton as far as it will go with said inner carton coming into contact with the inner surface of at least two of said first plurality of sides of said outer carton with the bottom of said product spaced-apart from the inner surface of at least one of said first plurality of sides of said outer carton following step c.;

e. inserting said blocking panel within said outer carton between the sides of said first plurality of sides of said outer carton that are not in contact with said inner carton and at least the bottom of said product for passively holding said product during shipment following step d.; and f. closing the flaps of said outer carton in preparation for shipment following step e.

6. A package assembly for protecting a product during shipping as in claim 1 wherein:

said outer carton has four rectangularly shaped sides and a rectangularly shaped bottom portion;

said inner carton means is locatable in contact with the inner surface three sides and the bottom portion of said outer carton; and said blocking means is locatable between the fourth of said four sides of said outer carton and at least the bottom of said product within said inner carton means.

7. A package assembly for protecting a product during shipping as in claim 6 wherein said inner carton means includes:

body means of a contiguous web that defines three vertical sides and a bottom portion, said bottom portion having an outline shape that matches the shape of the portion of said product that is to contact the bottom portion during shipment; and support block means affixed to the outer surfaces of said three sides and the bottom of said body means for spacing said inner carton means away from said three inner sides and bottom of said outer carton and for supporting said product in that position during shipment.

8. A package assembly for protecting a product during shipping as in claim 7 wherein said blocking means includes:

a web portion having a rectangular shape at least as large as the rectangular shape of the bottom of said product;

extension means for locating said web portion above the bottom of the inner surface of said outer carton and adjacent the bottom of said product; and support block means for spacing said web portion away from the inner surface of said fourth side of said outer carton and for maintaining said product in that position during shipment.

9. A package assembly for protecting a product during shipping as in claim 6 further comprising tray means for placement within said outer carton on top of said product within said inner carton, said tray means including support block means for spacing said product away from the inner surface of said flaps of said outer carton and for maintaining said product in that position during shipment.

10. A package assembly for protecting a product during shipping as in claim 9 wherein said blocking means and said tray means are hingedly attached one to the other.

11. A package assembly for protecting a product during shipping as in claim 9 wherein said tray means is hingedly attached to the top edge of one of said three sides of the body means of said inner carton.

12. A package assembly for protecting a product during shipping as in claim 10 wherein said outer carton further includes door means in one of said four sides of said outer carton adjacent to said tray means for loading selected items into said tray means through said door.

13. A package assembly for protecting a product during shipping as in claim 11 wherein said outer carton further includes door means in one of said four sides of said outer carton adjacent to said tray means for loading selected items into said tray means through said door.

14. A package assembly for protecting a product during shipping as in claim 6 wherein said fourth side of said outer carton is hingedly attached to the bottom of said outer carton and is sealed along the vertical edges of said fourth side and the adjacent sides of said outer carton with rip cord means for removal from said outer carton during unpacking to permit the rotation of the rest of said outer carton to its original position after the outer carton is rotated to the second position to leave said product sitting on said fourth side without the balance of said outer carton still surrounding said product.

15. A package assembly for protecting a product during shipping as in claim 6 wherein said fourth side of said outer carton is sealed along the vertical and bottom edges of said fourth side and the adjacent sides and bottom of said outer carton with rip cord means for removal from said outer carton during unpacking to permit the removal of the rest of said outer carton from the unpacking site after the outer carton is rotated to the second position to leave said product sitting on said fourth side without the balance of said outer carton still surrounding said product.

16. A method as in claim 3 wherein:

said outer carton has four rectangularly shaped sides and a rectangularly shaped bottom portion;

said inner carton means includes body means of a contiguous web that defines three vertical sides and a bottom portion, said bottom portion having an outline shape that matches the shape of the portion of said product that is to contact the bottom portion during shipment;

step a. includes locating said inner carton within said outer carton in contact with the inner surface of three of said four sides and the bottom thereof;

step b. includes loading said product within said inner carton with the bottom thereof facing the side of said inner carton that is adjacent the fourth side of said outer carton to be cradled therewithin during shipment following step a.; and step c. includes inserting said blocking panel within said outer carton between the fourth side of said outer carton and at least the bottom of said product for passively holding said product during shipment.

17. A method as in claim 16 further including the step of:

i. supporting said inner carton in a spaced-apart relationship to said three inner sides and bottom of said outer carton and for supporting said product in that position during shipment.

18. A method as in claim 16 further including the step of:

j. supporting said blocking panel in a spaced-apart relationship to the inner surface of said fourth side of said outer carton and for supporting said product in that position during shipment.

19. A method as in claim 16 further including the step of:

k. placing tray and support means within said outer carton on top of said product within said inner carton following step c. for spacing said product away from the inner surface of said flaps of said outer carton and for maintaining said product in that position during shipment.

20. A method as in claim 18 further including the step of:

l. placing tray and support means within said outer carton on top of said product within said inner carton following step c. for spacing said product away from the inner surface of said flaps of said outer carton and for maintaining said product in that position during shipment.

21. A method as in claim 20 wherein said blocking means and said tray and support means are hingedly attached one to the other.

22. A method as in claim 16 wherein said tray and support means is hingedly attached to the top edge of one of said three sides of the body means of said inner carton.

23. A method as in claim 21 wherein:

said outer carton further includes door means in one of said four sides of said outer carton adjacent to said tray means; and said method further includes the following step of:

m. loading selected items into said tray means through said door in a side in said outer carton following step d.

24. A method as in claim 22 wherein:

said outer carton further includes door means in one of said four sides of said outer carton adjacent to said tray means; and said method further includes the following step of:

n. loading selected items into said tray means through said door in a side in said outer carton following step d.

25. A method as in claim 4 wherein:

said outer carton has four rectangularly shaped sides and a rectangularly shaped bottom portion, and said fourth side of said outer carton is hingedly attached to the bottom of said outer carton and is sealed along the vertical edges of said fourth side and the adjacent sides of said outer carton with rip cord means;

said inner carton means includes body means of a contiguous web that defines three vertical sides and a bottom portion, said bottom portion having an outline shape that matches the shape of the portion of said product that is to contact the bottom portion during shipment;

step a. includes locating said inner carton within said outer carton in contact with the inner surface of three of said four sides and the bottom thereof;

step b. includes loading said product within said inner carton with the bottom thereof facing the side of said inner carton that is adjacent the fourth side of said outer carton to be cradled therewithin during shipment following step a.;

step c. includes inserting said blocking panel within said outer carton between the fourth side of said outer carton and at least the bottom of said product for passively holding said product during shipment;

said method further includes the steps of:

o. removing said rip cord means from said outer carton prior to step g.;

p. rotating the first three side and the bottom of said outer carton to its original position of step f. following step g. to leave said product sitting on said fourth side without the balance of said outer carton still surrounding said product.

26. A method as in claim 4 wherein:

said side of said outer carton adjacent the bottom of the enclosed product is hingedly attached to the bottom of said outer carton and is sealed along its vertical edges to the adjacent sides of said outer carton with rip cord means;

said method further includes the steps of:

o. removing said rip cord means from said outer carton prior to step g.;

p. rotating the first three side and the bottom of said outer carton to its original position of step f. following step g. to leave said product sitting on said adjacent side without the balance of said outer carton still surrounding said product.

27. A method as in claim 4 wherein:

said side of said outer carton adjacent the bottom of the enclosed product is sealed along its vertical edges to the adjacent sides and its horizontal edge with the bottom of said outer carton with rip cord means;

said method further includes the steps of:

q. removing said rip cord means from said outer carton prior to step g.;

r. removing the first three sides and the bottom of said outer carton from the side adjacent the bottom of said product following step g. to leave said product sitting on said adjacent side without the balance of said outer carton still surrounding said product.

28. A method as in claim 4 wherein:

said package assembly further includes tray means for placement within said outer carton on top of said product within said inner carton and support block means for spacing said tray means and said product away from the inner surface of said flaps of said outer carton to maintain said product in that position during shipment;

said method further including the step of:

s. removing said tray means and said support block means from said outer container following step e.

29. A method as in claim 28 wherein:

said blocking means and said tray means are hingedly attached on to the other; and step f. includes the step of:

t. removing the combination of said blocking panel and said tray means.

30. A method as in claim 28 wherein:

said inner carton includes a third plurality of vertically oriented sides and a bottom with said bottom having at least one free edge toward which the bottom of said product is oriented for shipment;

said tray means is hingedly attached to the top edge of one of said third plurality of sides of said inner carton; and the method further includes the step of:

u. rotating said tray means away from said product prior to step h.

* * * * *